US009128465B2

(12) United States Patent
Kawauchiya et al.

(10) Patent No.: US 9,128,465 B2
(45) Date of Patent: Sep. 8, 2015

(54) BALANCE WITH HAIRSPRING, MOVEMENT, AND TIMEPIECE

(71) Applicant: SEIKO INSTRUMENTS INC., Chiba-shi, Chiba (JP)

(72) Inventors: Takuma Kawauchiya, Chiba (JP); Takashi Niwa, Chiba (JP); Masahiro Nakajima, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days.

(21) Appl. No.: 14/573,104

(22) Filed: Dec. 17, 2014

(65) Prior Publication Data

US 2015/0185700 A1 Jul. 2, 2015

(30) Foreign Application Priority Data

Dec. 27, 2013 (JP) ..... 2013-273239
Sep. 26, 2014 (JP) ..... 2014-197238

(51) Int. Cl.
*G04B 17/06* (2006.01)
*G04B 15/06* (2006.01)

(52) U.S. Cl.
CPC ..... *G04B 17/063* (2013.01); *G04B 15/06* (2013.01); *G04B 17/06* (2013.01)

(58) Field of Classification Search
CPC ..... G04B 17/06; G04B 17/063; G04B 18/06; G04B 18/08
USPC ..... 368/169–170, 176–178
See application file for complete search history.

(56) References Cited

U.S. PATENT DOCUMENTS

| | | | | |
|---|---|---|---|---|
| 1,951,995 | A * | 3/1934 | Schaad | 368/169 |
| 2,770,942 | A * | 11/1956 | Favret | 368/171 |
| 2,880,570 | A | 4/1959 | Favret et al. | 58/107 |
| 7,661,875 | B2 | 2/2010 | Verardo et al. | 368/171 |
| 2012/0014229 | A1* | 1/2012 | Mallet et al. | 368/175 |
| 2014/0185418 | A1* | 7/2014 | Nakajima et al. | 368/127 |
| 2014/0241134 | A1* | 8/2014 | Niwa et al. | 368/127 |

* cited by examiner

*Primary Examiner* — Sean Kayes
(74) *Attorney, Agent, or Firm* — Adams & Wilks

(57) ABSTRACT

To provide a timepiece balance with hairspring capable of changing the moment of inertia of the balance wheel without involving generation of a one-sidedness in weight. There is provided a balance with hairspring including a balance staff, and a balance wheel arranged around the balance staff, wherein there are provided a first rim constituting the balance wheel and having a guide portion configured to vary in the distance from the balance staff in correspondence with a peripheral direction around the balance staff, an elastic portion arranged so as to be slidable along the guide portion and capable of elastic deformation in the radial direction around the balance staff, and a second rim having a plurality of weight portions arranged in the peripheral direction.

20 Claims, 10 Drawing Sheets

SECTION A-A

SECTION A-A

SECTION A-A

BALANCE WITH HAIRSPRING, MOVEMENT, AND TIMEPIECE

BACKGROUND OF THE INVENTION

1. Field of the Invention

The present invention relates to a balance with hairspring mounted in a timepiece, a movement including the balance with hairspring, and a timepiece.

2. Description of the Related Art

As a mechanism for adjusting the rate of a mechanical timepiece, a free sprung balance is known (See, for example, U.S. Pat. No. 7,661,875 (Patent Literature 1)). The free sprung balance is a mechanism that varies the moment of inertia of a balance with hairspring to vary the vibration cycle thereof, thereby adjusting the losing and gaining of the timepiece. The vibration cycle of the balance with hairspring can be expressed by equation (1).

[Math. 1]

$$T = 2\pi\sqrt{\frac{I}{K}} \qquad \text{Equation (1)}$$

When the moment of inertia of the balance with hairspring is larger than that expressed by equation (1), the vibration cycle of the balance with hairspring is long; and when the moment of inertia of the balance with hairspring is smaller than that expressed by equation (1), the vibration cycle of the balance with hairspring is short. As a method of varying the moment of inertia, there is generally used a weight; by moving the weight in the radial direction, the moment of inertia is varied.

In this conventional technique, the positions of a plurality of screwed weights are separately adjusted, so that if the movement amount of each weight differs even if slightly, the center of gravity of the balance with hairspring is deviated from the rotational axis, and there is a fear of the vibration cycle of the balance with hairspring in the upright attitude being disturbed.

Further, there is known a mechanism in which the positions of weights are moved along arms also serving as a guide to thereby adjust the moment of inertia (See, for example, U.S. Pat. No. 2,880,570 (Patent Literature 2)). The positions of the weights are regulated by a weight position regulation member; by rotating this component with respect to the balance staff, it is advantageously possible to move the weights situated opposite the rotational axis by the amount.

In the conventional technique, however, there cannot but exist, from the viewpoint of manufacture, a clearance between the weight and the guide rail and between the weight and the weight position regulation member; and, due to this clearance, there is the possibility of the positions of opposite weights being deviated. When the positions of opposite weights are deviated, the center of gravity of the balance with hairspring is separated from the rotational axis, and there is attained a single-sidedness in weight, in which the position of the center of gravity is single-sided, so that there is a fear of the vibration cycle of the balance with hairspring in the upright attitude being disturbed.

SUMMARY OF THE INVENTION

It is an aspect of the present application to provide a balance with hairspring, a movement, and a timepiece which can vary the moment of inertia of the balance wheel without generating a single-sidedness in weight.

According to the present application, there is provided a balance with hairspring including a balance staff, and a balance wheel arranged around the balance staff, wherein there are provided a first rim constituting the balance wheel and having a guide portion configured to vary in the distance from the balance staff in correspondence with a peripheral direction around the balance staff, an elastic portion arranged so as to be slidable along the guide portion and capable of elastic deformation in the radial direction around the balance staff, and a second rim having a plurality of weight portions arranged in the peripheral direction.

Due to this feature, it is possible to adjust the moment of inertia of the balance wheel while effectively suppressing the clearance between the first rim and the second rim having the weight portions, so that it is possible to suppress a single-sidedness in weight of the balance wheel.

Further, according to the present application, there is provided a balance with hairspring, wherein the second rim has a contact portion configured to come into contact with the first rim through the elastic deformation of the elastic portion; and the contact portion is formed in the vicinity of the weight portions.

Due to this feature, the elastic portion of the second rim comes solely into contact with the contact portion, whereby it is easier to control the portions brought into contact with each other, making it possible to precisely adjust the distance between the weight portions and the balance staff.

Further, according to the present application, there is provided a balance with hairspring, wherein the guide portion has an inclined surface inclined such that the distance from the balance staff uniformly varies along the peripheral direction around the balance staff.

Due to this feature, when adjusting the distance between the weight portions and the balance staff, it is possible to adjust the distance at a uniform ratio, so that it is possible to reliably secure a desired moment of inertia.

Further, according to the present application, there is provided a balance with hairspring, wherein the second rim has an engagement portion configured to be engaged with the first rim through elastic deformation of the elastic portion; and the engagement portion is engaged with the first rim, whereby the sliding movement of the second rim along the guide portion is fixed.

Due to this feature, the first rim and the second rim are reliably engaged with each other due to the engagement portion, so that it is possible, in particular, to suppress relative deviation of the first rim and the second rim in the axial direction of the balance staff. Thus, it is possible to adjust the moment of inertia of the balance wheel in a more stable manner.

Further, according to the present application, there is provided a balance with hairspring, wherein the first rim is equipped with a slit having a width smaller than the diameter of the balance staff.

Due to this feature, offset of the first rim and the balance staff is suppressed due to the resiliency of the slit, so that it is possible to precisely adjust the distance of the guide portion from the balance staff.

Further, according to the present application, there is provided a balance with hairspring, wherein the first rim has a support portion at a fixed distance from the balance staff in correspondence with the peripheral direction around the balance staff; the guide portion is formed between a first end portion at a first distance from the balance staff and a second end portion at a second distance from the balance staff which is smaller than the first distance; and the elastic portion is formed in an arc length smaller than the arc length between the first end portion and the second end portion on the support portion.

Due to this feature, even when adjustment is made such that the distance between the weight portions and the balance staff is large, the amount of protrusion from the guide portion is suppressed, making it possible to suppress the increase in the outer diameter of the balance wheel as much as possible. Thus, it is possible to increase the degree of freedom when arranging the balance with hairspring in the timepiece.

Further, according to the present application, there is provided a balance with hairspring, wherein the guide portion is formed on the outer peripheral surface of the first rim.

Due to this feature, it is possible to adjust the moment of inertia of the balance wheel in a more stable manner.

Further, according to the present application, there is provided a balance with hairspring, wherein the guide portion is formed on the inner peripheral surface of the first rim.

Due to this feature, it is possible to suppress relative deviation of the first rim and the second rim because of a centrifugal force or the like, making it possible to adjust the moment of inertia of the balance wheel in a more stable manner.

Further, according to the present application, there is provided a balance with hairspring, wherein the guide portion has an auxiliary guide portion retaining the elastic portion from the outer peripheral side.

Due to this feature, relative deviation of the first rim and the second rim is further suppressed, and it is possible to adjust the moment of inertia of the balance wheel in a more stable manner.

Further, according to the present application, there is provided a balance with hairspring, wherein there is provided a rim formed of a bimetal.

Due to this feature, it is possible to provide a balance with hairspring the vibration cycle of which is not easily changed even if the temperature changes.

Further, according to the present application, there is provided a balance with hairspring, wherein there is provided a phase adjustment mechanism for adjusting the phase of the first rim and of the second rim.

Due to this feature, it is possible to adjust the phase of the first rim and of the second rim easily and accurately.

Further, according to the present application, there is provided a timepiece movement which is equipped with an escapement/governor mechanism including the above-mentioned balance with hairspring, and a train wheel.

Further, according to the present application, there is provided a timepiece which contains the above-mentioned movement, and is equipped with an exterior member having a dial.

Due to this feature, it is possible to provide a timepiece the movement of which is properly protected.

DETAILED DESCRIPTION OF THE PREFERRED EMBODIMENTS

The first embodiment according to the present invention will be described with reference to FIGS. 1 through 6.

Figure 1:
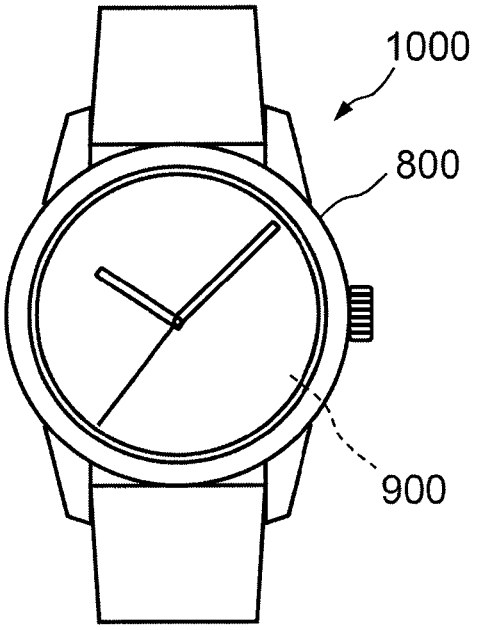
FIG. 1 is a structural diagram illustrating a timepiece according to a first embodiment of the present invention.
Figure 2:
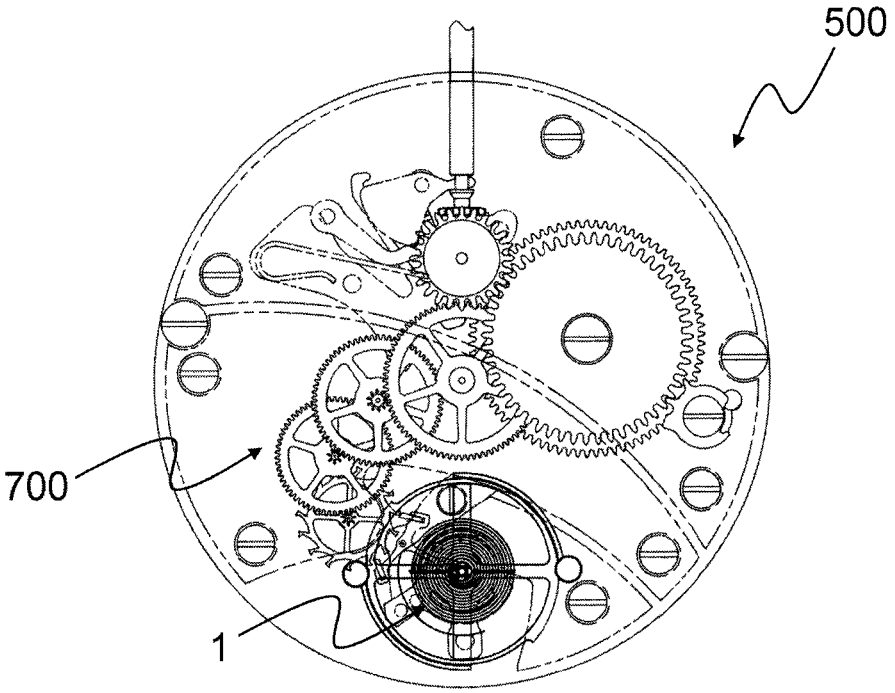
FIG. 2 is a structural diagram illustrating a movement to be incorporated into the timepiece according to the first embodiment of the present invention.

First, a timepiece and a movement will be schematically described with reference to FIGS. 1 and 2. FIG. 1 is a structural view illustrating the timepiece, and FIG. 2 is a structural view illustrating the movement to be incorporated into the timepiece.

A movement 500 to be mounted in a mechanical timepiece (timepiece) 1000 has a mainspring installed in a barrel drum thereof. The power accumulated in the mainspring is transmitted from a movement barrel to a center wheel & pinion, a third wheel & pinion, and a second wheel & pinion before being transmitted to an escape wheel & pinion. This drive by a train wheel 700 is transmitted to an escapement/governor mechanism. The escape wheel & pinion and a pallet fork mainly function as an escapement mechanism, and a balance with hairspring 1 performs speed government.

Figure 3A:
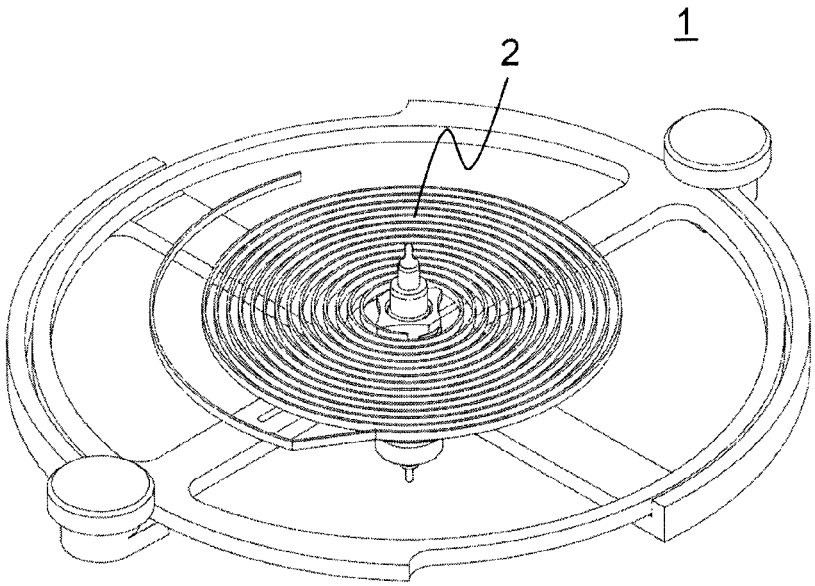
FIG. 3A is a perspective view of a balance with hairspring to which a hairspring according to the first embodiment of the present invention is mounted.
Figure 3B:
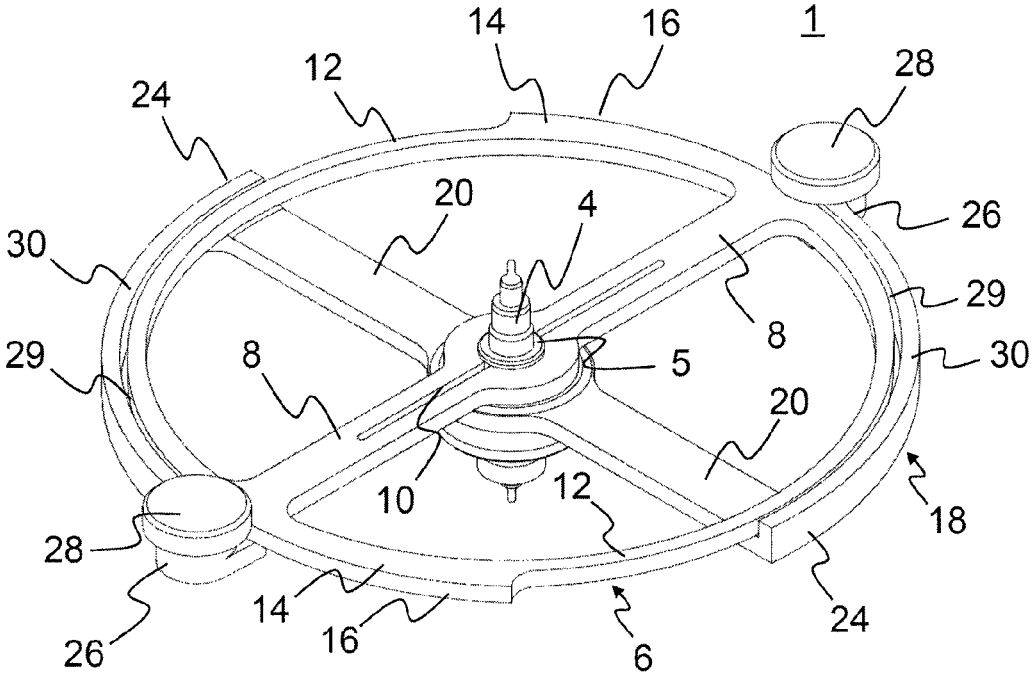
FIG. 3B is a perspective view of a balance with hairspring from which the hairspring according to the first embodiment of the present invention has been removed.

Next, the balance with hairspring incorporated into the movement will be described with reference to FIG. 3. FIG. 3A is a perspective view of the balance with hairspring 1 to which a hairspring 2 is mounted, and FIG. 3B is a perspective view of the balance with hairspring 1 with the hairspring 2 removed therefrom.

The balance with hairspring 1 has a balance staff 4 supported so as to be rotatable with respect to a main plate and a movement support plate called bridge through the intermediation of a bearing including a hole jewel and a cap jewel. Integrally mounted to the balance staff 4 is a balance wheel 6, 18 through the intermediation of arms 8 and 20 called "arms".

The balance wheel may be molded integrally with the arms or may be formed integrally through fit-engagement or the like. In any case, the balance wheel 6, 18 is rotatable around the axis of the balance staff 4. The balance wheel has a second rim 18 fixed to the balance staff 4 via the second arm 20, and a first rim 6 rotatable relative to the second rim 18.

The first rim 6 is formed integrally with the first arm 8. At the central portion thereof, the first arm 8 has a slit 10 narrower than the shaft width of the balance staff 4; this slit 10 is slightly widened to be fit-engaged with the balance staff 4, whereby the balance staff 4 and the first rim 6 are supported so as to be capable of relative rotation due to the resiliency of the slit 10. Further, to prevent detachment of the first rim 6 from the balance staff 4, the balance staff 4 has a first flange portion 5.

The first rim 6 is formed in an annular configuration in the form of a closed arc, and is composed of a support portion 12 having a circumference of an outer diameter at the same distance as measured from the balance staff 4, and a guide portion 14 of an outer diameter which is not of the same distance as measured from the balance staff. The guide portion 14 is inclined such that the outer diameter thereof, i.e., the distance from the balance staff 4, is changed uniformly along the circumferential direction. This inclined surface 16 functions to guide the second rim 18 described below. The inclined surface 16 is provided on the outer peripheral side of the first rim 6. As it extends from a first end portion 34 toward a second end portion 36 in the circumference of the first rim 6, the inclined surface 16 increases in its distance from the balance staff 4.

Further, due to the resiliency of the slit 10, the first rim 6 is fit-engaged with the balance staff 4, whereby offset of the first rim 6 and the balance staff 4 is suppressed, so that the distance of the two guide portions 14 from the balance staff 4 can be easily maintained equal. Thus, the distance from the balance staff of the second rim 18 described below which is guided by the guide portions 14 is also uniform, and the position of the center of gravity of the balance with hairspring is always maintained near the rotational axis of the balance staff 4. Thus, it is possible to suppress disturbance in accuracy due to one-sidedness in weight (unbalance in the center of gravity during rotation).

To suppress generation of one-sidedness in weight of the balance with hairspring 1, it is desirable for the first rim 6 to be formed in the correct configuration. Thus, the first rim 6 is machined by a technique of high form machining accuracy, such as UV-LIGA (Ultraviolet Lithographie Galvanoformung Abformung) or DRIE (Deep Reactive Ion Etching) or MIM (Metal Injection Molding). Further, the first rim 6 is formed of a material suitable for the above machining methods, such as a metal material like nickel, or a material exhibiting crystal orientation such as single-crystal silicon.

Here, when adjusting the moment of inertia, the inclined surface 16 slides on the second rim 18. Thus, it is desirable for the first rim 6 to be formed of a material of high hardness. Nickel and silicon exhibit high hardness, and are suitable as the material of the first rim 6.

The second rim 18 is connected to the balance staff 4 via the second arm 20. A through-hole 22 is provided at the central portion of the second arm 20; the balance staff 4 is inserted into this through-hole 22, whereby the second arm 20 and the balance staff 4 are fixed to each other. Here, the second rim 18 is formed in an arcuate configuration, and has a stationary end 24 fixed to the second arm 20, and a free end 26 formed on the side opposite the stationary end 24 as seen in the peripheral direction. The free end 26 is not fixed to the second arm 20, so that it can be displaced by an inertial force, an external force or the like. A plurality of weight portions 28 are mounted to the free end 26. By arbitrarily adjusting the volume, weight, position, etc. of the weight portions 28, it is possible to adjust the moment of inertia of the balance with hairspring 1. Here, an elastic portion 30 is formed between the stationary end 24 and the free end 26 of the second rim 18. Further, the elastic portion 30 has an engagement portion 32 engaged with the guide portion 14 of the first rim 6. The engagement portion 32 serves to enhance the closeness in the contact between the elastic portion 30 of the second rim 18 and the guide portion 14 of the first rim 6. In the present embodiment, the engagement portion 32 protrudes from the second rim 18 toward the first rim 6, and abuts the end surface in the axial direction of the balance staff 4 of the first rim 6, whereby it is possible to prevent positional deviation between the first rim 6 and the second rim 18 in the balance staff axial direction.

The elastic portion 30 is formed of a material capable of elastic deformation. Examples of the material include iron, stainless steel, carbon steel, brass, resin, nickel alloy, invar, and phosphor bronze. Before the assembly, the elastic portion 30 (which is in the natural length state) is set to a curvature larger than the curvature of the annular first rim 6. Due to this difference in curvature, the second rim 18 can be brought into close contact with the first rim 6 without involving any clearance.

A gap 29 is provided between the first rim 6 and the second rim. In this connection, there is provided, at the free end 26, a contact portion **26*a* arcuately protruding toward the first rim. Due to the gap 29 and the contact portion 26*a*, solely the contact portion 26*a* of the elastic portion 30 is brought into line contact with the first rim 6. Since the contact portion 26*a* is brought into contact with the first rim 6 solely at a single point, the contact position is precisely specified, so that the distance between the two free ends 26 and the balance staff 4 can be easily maintained equal. That is, the distance between the weight portions 28 and the balance staff 4 can be easily maintained equal, making it possible to suppress the generation of one-sidedness in weight. Further, due to the gap 29, the portions of the elastic portion 30 other than the contact portion 26*a* are not allowed to come into contact with the first rim 6. Thus, it is possible to avoid a condition in which the free end 26 cannot be brought into close contact with the first rim because of the portions of the elastic portion 30 other than the contact portion 26*a* coming into contact with the first rim 6**.

Figure 4:
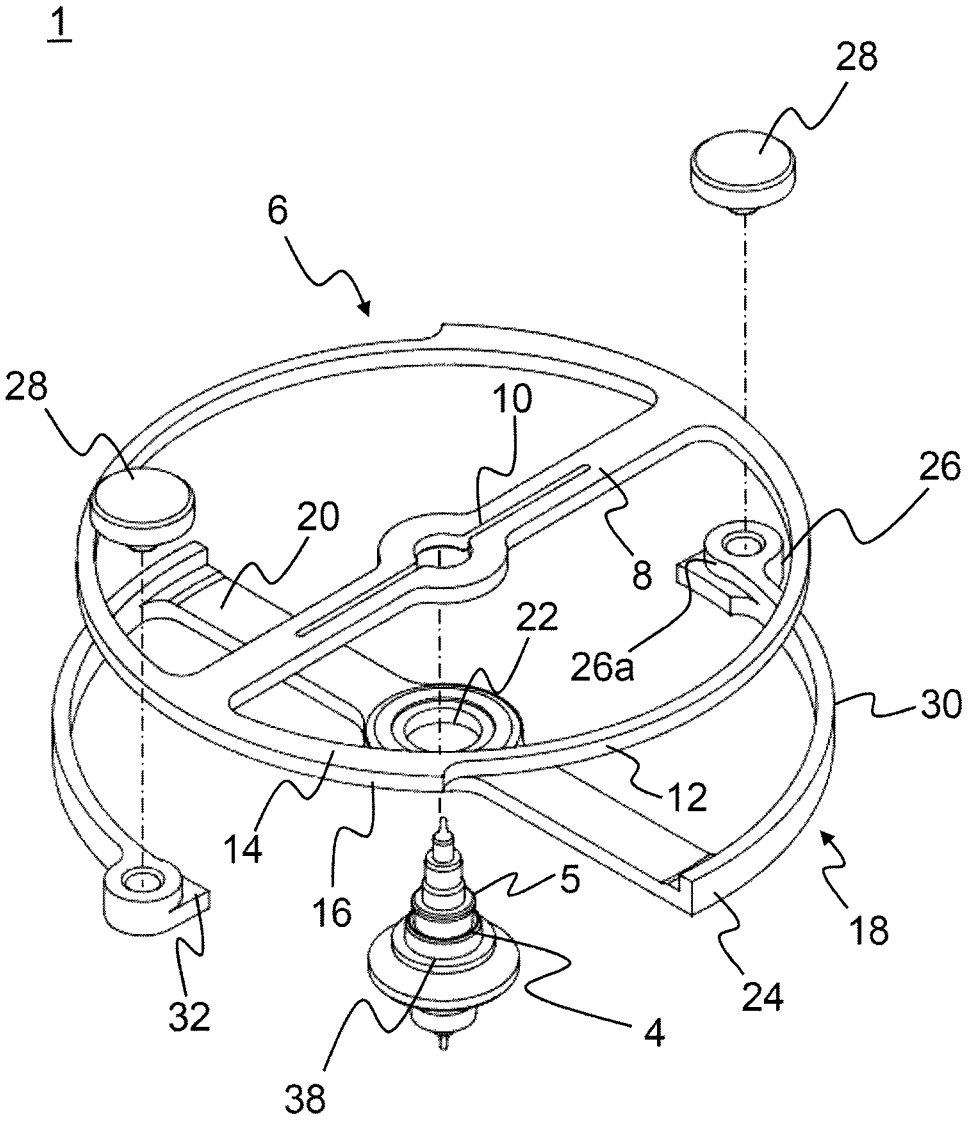
FIG. 4 is an exploded view of the balance with hairspring according to the first embodiment of the present invention.

Next, the order in which the balance with hairspring is assembled will be described with reference to FIG. 4. FIG. 4 is an exploded view of the balance with hairspring 1.

The balance staff 4 is inserted into a through-hole 22 at the center of the second rim 18; it is inserted until the second arm 20 of the second rim 18 abuts a second flange portion 38 expanding in the radial direction of the balance staff 4. The inner diameter of the through-hole 22 is formed smaller than the outer diameter of the insertion portion of the balance staff 4 by, for example, 1/100 mm; due to this difference in diameter, the second rim 18 can be fixed in so as to be incapable of relative rotation through the forcing-in of the balance staff 4.

Subsequently, the balance staff 4 is inserted into the slit 10 at the center of the first rim 6, and the first rim 6 is fit-engaged with the balance staff 4. At the center of the first rim 6, there is provided the slit 10 of a smaller width than the shaft width of the balance staff 4; this slit 10 is slightly expanded to allow insertion of the balance staff 4, whereby the first rim 6 is maintained so as to be capable of relative rotation due to resiliency. At this time, the first rim 6 is also held in contact with the engagement portion 32 of the second rim 18.

By the above procedures, the balance staff 4 and the first rim 6 are supported so as to be capable of relative rotation, and the second rim 18 is fixed to the balance staff 4 so as to be incapable of rotation.

After this, each weight portion 28 is mounted near each free end 26 of the second rim 18. Here, the first rim 6 is held between the weight portions 28 and the second rim 18. Due to this arrangement, it is possible to prevent relative positional deviation in the balance staff axial direction between the guide portion 14 of the first rim 6 and the free ends 26 of the second rim 18.

Figure 5A:
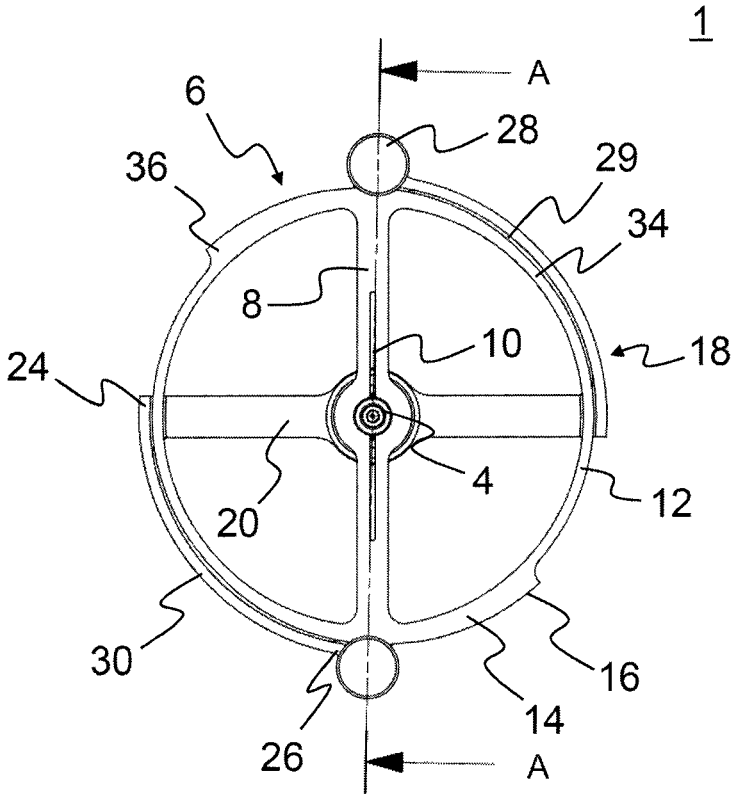
FIG. 5A is a plan view of the balance with hairspring according to the first embodiment of the present invention when the moment of inertia thereof is set to medium.
Figure 5B:
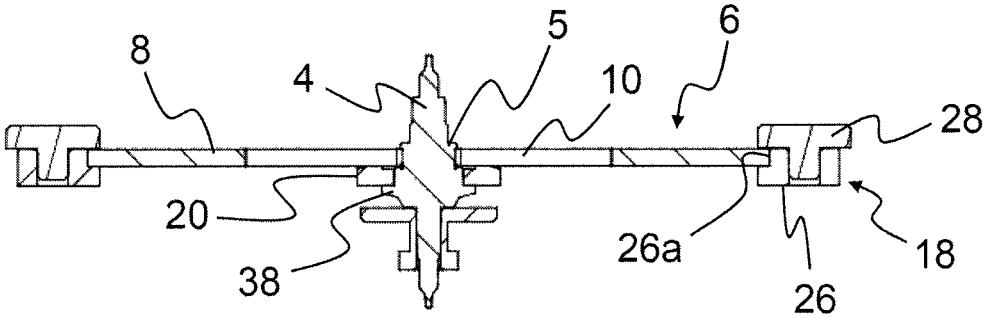
FIG. 5B is a sectional view taken along the line AA of FIG. 5A.
Figure 6A:
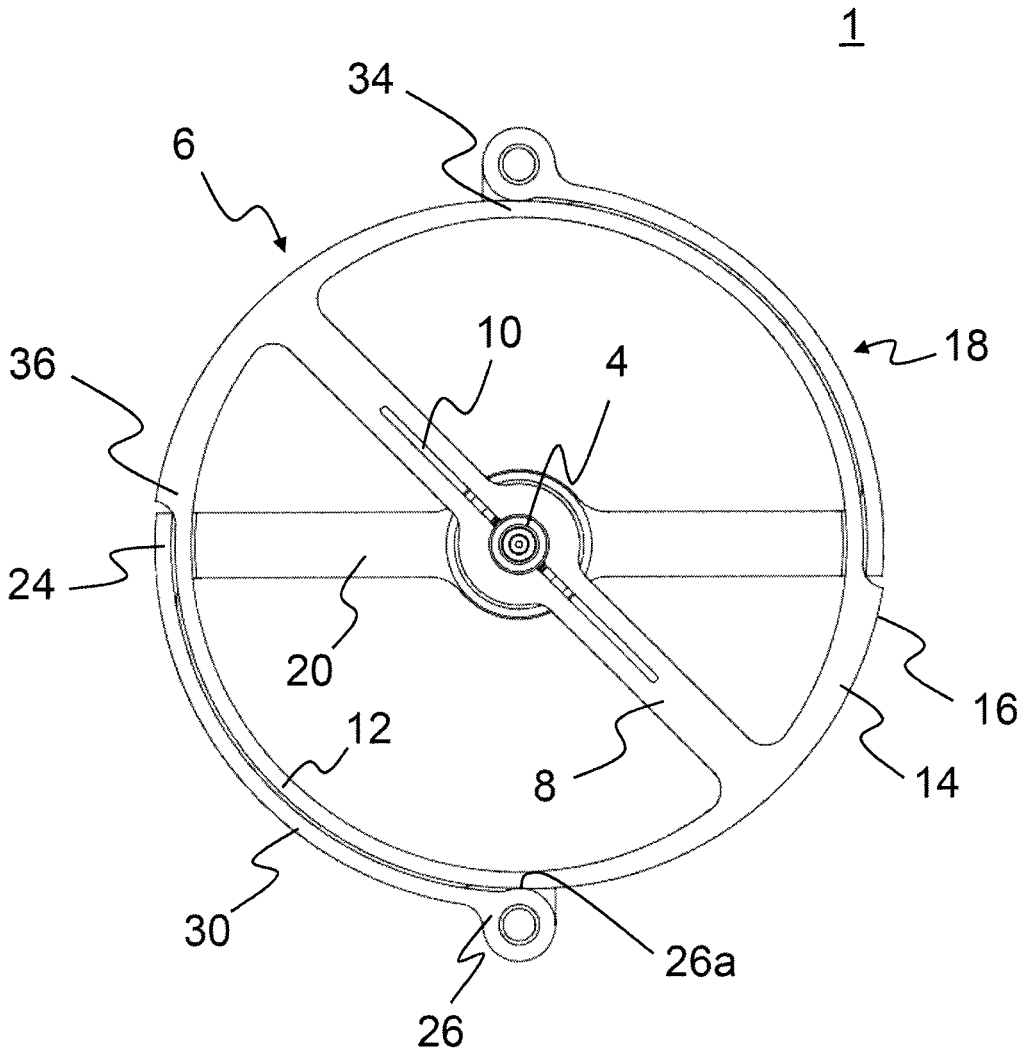
FIG. 6A is a plan view of the balance with hairspring according to the first embodiment of the present invention when the moment of inertia thereof is set to minimum.
Figure 6B:
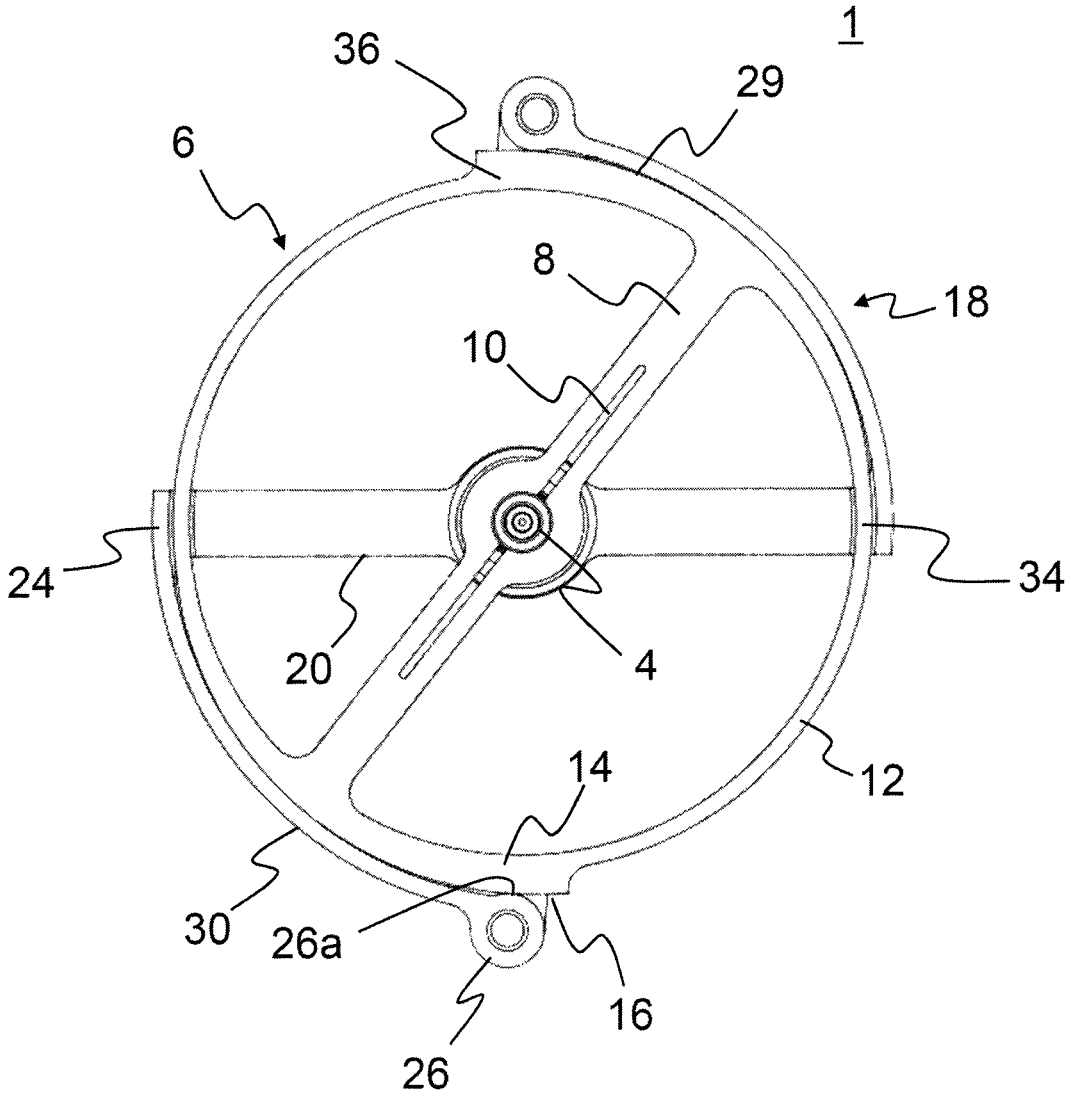
FIG. 6B is a plan view of the balance with hairspring according to the first embodiment of the present invention when the moment of inertia thereof is set to maximum.

Next, a method of adjusting the moment of inertia of the balance with hairspring will be described with reference to FIGS. 5 and 6. FIG. 5A is a plan view of the balance with hairspring when the moment of inertia thereof is set to medium; FIG. 6A is a plan view of the balance with hairspring when the moment of inertia thereof is set to minimum; and FIG. 6B is a plan view of the balance with hairspring when the moment of inertia thereof is set to maximum. FIG. 5B is a sectional view taken along the line AA of FIG. 5A.

When adjusting the moment of inertia of the balance with hairspring 1, the first rim 6 is caused to rotate with respect to the balance staff 4 and the second rim 18, and the inclined surface 16 of the guide portion 14 is caused to slide with respect to the weight portions 28 of the second rim 18. Due to the sliding of the inclined surface 16, the distance between the weight portions 28 and the balance staff 4 is changed. Thus, it is possible to adjust the moment of inertia of the balance with hairspring 1.

The elastic portion 30 coming into contact with the inclined surface 16 is capable of elastic deformation so as to come into close contact with the first rim 6, so that the mutual position between the first rim 6 and the second rim 18 can be fixed easily.

Here, for example, when setting the moment of inertial small, the first end portion 34 of each inclined surface 16 is set to be near the weight portion 28 as shown in FIG. 6A. On the other hand, when setting the moment of inertia large, the second end portion 36 of each inclined surface 16 is set to be near the weight portion 28 as shown in FIG. 6B.

In the state as shown in FIG. 6A, in which the moment of inertia is set to be small, the elastic portion 30 is arranged between the first end portion 34 of one guide portion 14 and the second end portion 36 of the adjacent guide portion 14. As a result, the amount of protrusion from the guide portion is suppressed, making it possible to suppress as much as possible to outer diameter of the balance wheel. Further, the outer diameter is suppressed, with the moment of inertia being set small, so that even in the state of FIG. 6B, in which the moment of inertia is set large, the amount of protrusion from the guide portion is suppressed, making it possible to suppress the outer diameter of the balance wheel as much as possible. Thus, the degree of freedom when arranging the balance with hairspring in the timepiece is enhanced.

Figure 7A:
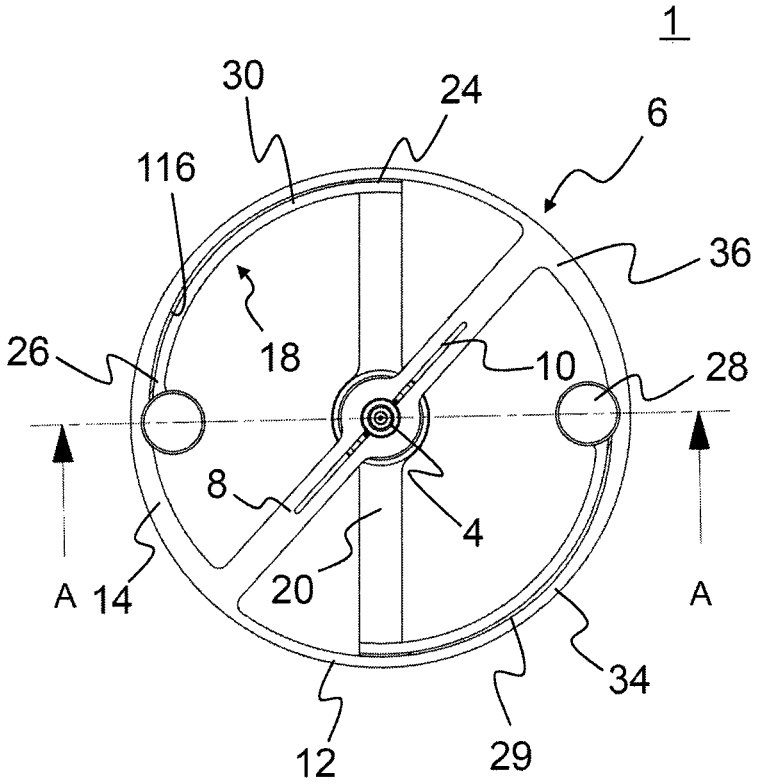
FIG. 7A is a plan view of the balance with hairspring according to a second embodiment of the present invention when the moment of inertia thereof is set to medium.
Figure 7B:
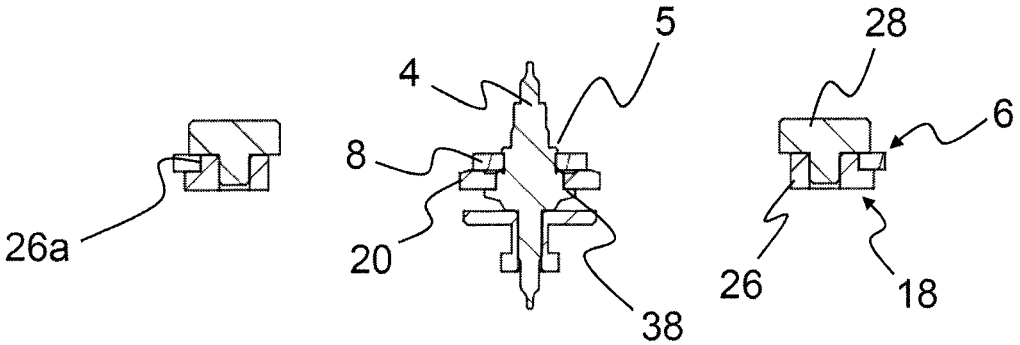
FIG. 7B is a sectional view taken along the line AA of FIG. 7A.

Next, the second embodiment of the present invention will be described with reference to FIG. 7. FIG. 7A is a plan view of the balance with hairspring when the moment of inertia thereof is set to medium, and FIG. 7B is a sectional view taken along the line AA of FIG. 7A. The components that are the same as those of the first embodiment are indicated by the same reference numerals, and a description thereof will be left out.

The present embodiment differs from the first embodiment in that the elastic portion before the assembly (in the natural-length state) is set to a curvature smaller than that of the first rim, and in that the inclined surface of the guide portion is provided on the inner peripheral side of the first rim.

In the present embodiment, an inclined surface 116 is formed on the inner peripheral surface of the first rim 6. The free end of the elastic portion 30 of the second rim 18 striving to be restored in the outer diameter direction is suppressed by the inner peripheral surface of the annular first rim 6, so that even when the balance with hairspring is rotating, the possibility of the second rim 18 being separated from the first rim 6 due to a force such as the centrifugal force exerting on the weight portions 28 is still lower.

Further, by arranging the weight portions on the inner side of the annular first rim, there is no portion protruding from the balance wheel, thus making it possible to suppress the outer diameter of the balance wheel to be small. Thus, the degree of freedom when arranging the balance with hairspring in the timepiece is enhanced. Further, since there is no portion protruding from the balance wheel, it is possible to reduce the energy loss due to the viscous friction resistance of the air.

Figure 8A:
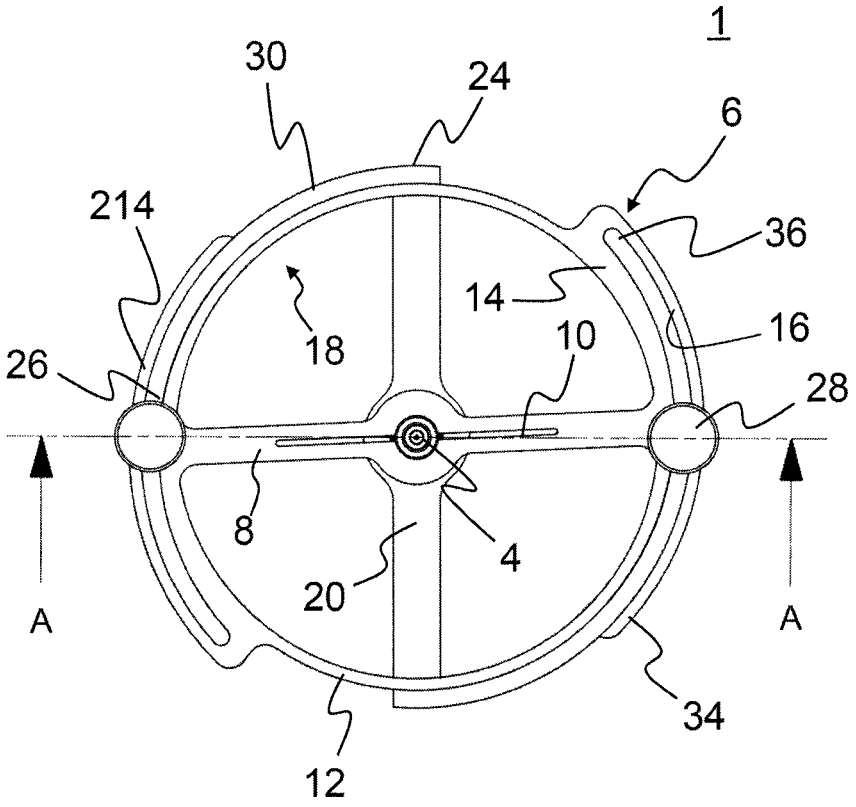
FIG. 8A is a plan view of the balance with hairspring according to a third embodiment of the present invention when the moment of inertia thereof is set to medium.
Figure 8B:
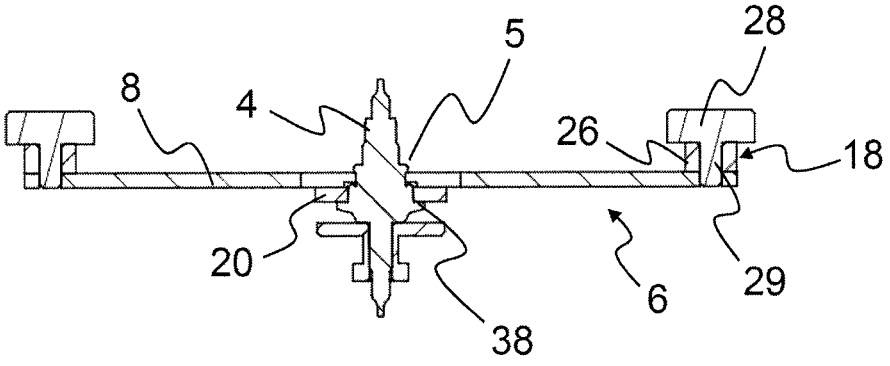
FIG. 8B is a sectional view taken along the line AA of FIG. 8A.

Next, the third embodiment of the present invention will be described with reference to FIG. 8. FIG. 8A is a plan view of the balance with hairspring when the moment of inertia thereof is set to medium, and FIG. 8B is a sectional view taken along the line AA of FIG. 8A. The components that are the same as those of the first embodiment are indicated by the same reference numerals, and a description thereof will be left out.

The present embodiment differs from the first embodiment in that the elastic portion before the assembly (which is in the natural-length state) is set to a curvature smaller than that of the annular first rim, and in that the guide portion of the first rim guides the elastic portion of the second rim from both sides.

In the present embodiment, the first rim 6 further has an auxiliary guide portion 214 formed integrally and continuously with the guide portion 14 on the inner peripheral side. Further, each weight portion 28 has a protrusion 29. The protrusion 29 is formed such that the end portion thereof protrudes from the free end 26 while being forced into the free end 26. The auxiliary guide portion 214 comes into contact with each protrusion 29 from the outer peripheral side, whereby the second rim 18 is not separated on the outer peripheral side. Thus, even when the balance with hairspring rotates, the possibility of the second rim 18 being separated from the first rim 6 due to a force such as the centrifugal force acting on the weight portions 28 is still lower. Further, even if the elastic portion 30 and the weight portions 28 are deflected radially inwards due to an external shock such as fall, each protrusion 29 comes into contact with the guide portion 14 to prevent this. Thus, the possibility of the second rim 18 being separated from the first rim 6 is still lower.

In the above embodiment, the second rim constituting the balance wheel is closely mounted to the first rim due to the elastic portion, so that it is possible to suppress the radial position of the weight portion of the second rim from becoming uneven in correspondence with the peripheral direction. Thus, it is possible to provide a balance with hairspring adjusted in the moment of inertial while being suppressed in one-sidedness in weight.

Figure 9A:
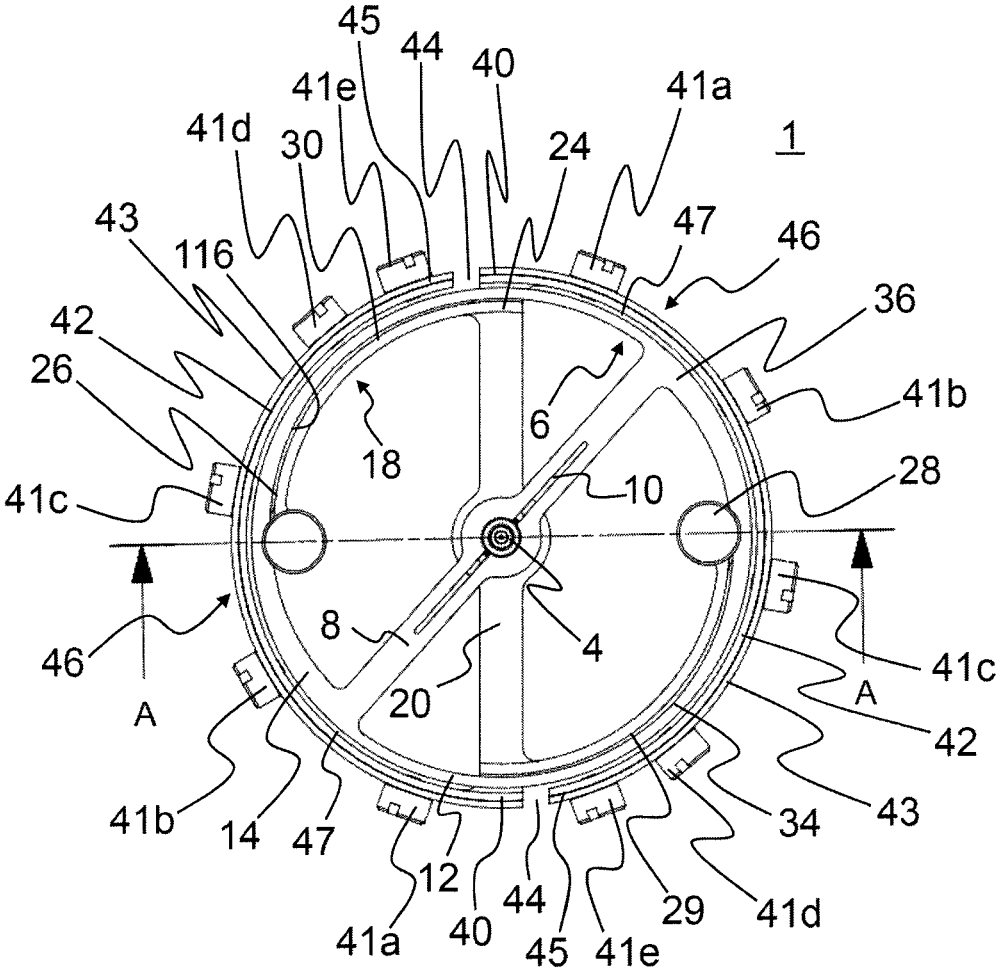
FIG. 9A is a plan view of the balance with hairspring according to a fourth embodiment of the present invention when the moment of inertia thereof is set to medium.
Figure 9B:
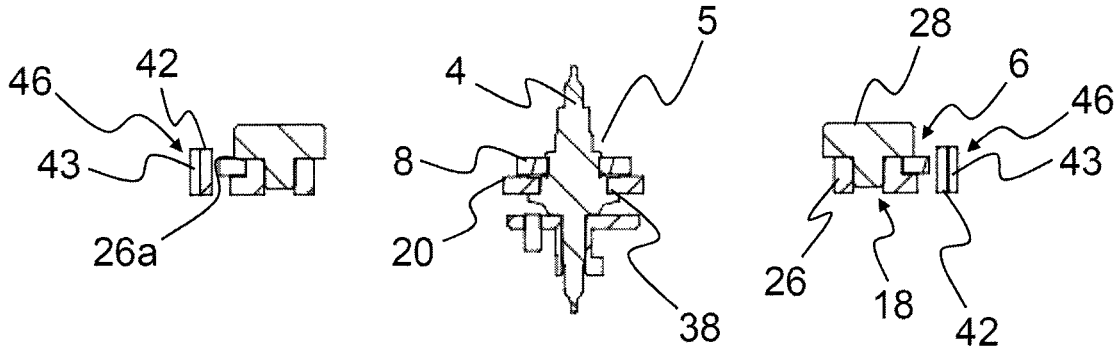
FIG. 9B is a sectional view taken along the line AA of FIG. 9A.

Next, the fourth embodiment of the present invention will be described with reference to FIG. 9. FIG. 9A is a plan view of the balance with hairspring when the moment of inertia thereof is set to medium, and FIG. 9B is a sectional view taken along the line AA of FIG. 9A. The components that are the same as those of the second embodiment are indicated by the same reference numerals, and a description thereof will be left out.

The present embodiment is a modification of the second embodiment; it differs from the second embodiment in that a bimetal rim 46, which is a rim formed of a bimetal, and a temperature correction amount adjustment screw 41 are arranged radially on the outer side of the first rim 6.

In the present embodiment, the second arm 20 extends radially on the outer side of the stationary end 24 of the second rim 18, and a stationary end 40 of the bimetal rim 46 is fixed to the tip end of the extending second arm 20. The bimetal rim 46 is cut at two cut portions 44, and the portion thereof on the side peripherally opposite the stationary end 40 is formed as a free end 45 which is not connected to the second arm. A gap 47 is provided between the bimetal rim 46 and the first rim 6, and the bimetal rim 46 and the first rim are retained so as not come into contact with each other. The bimetal rim 46 is composed of an inner rim 42 formed of a material of relatively low coefficient of thermal expansion, and an outer rim 43 formed of a material of relatively high coefficient of thermal expansion, with the inner rim 42 and the outer rim 43 being bonded together by brazing or the like. Examples of the material combination of the inner rim 42 and the outer rim 43 include (brass and steel), (brass and invar), and (stainless steel and invar). The bimetal rim is provided with screw holes arranged at fixed circumferential intervals, with a temperature correction amount adjustment screw 41 being mounted to each screw hole. The number of screw holes is larger than the number of temperature correction amount adjustment screws; in FIG. 9A, screw holes (not shown) are provided between the temperature correction amount adjustment screws 41*a*, 41*b*, 41*c*, and 41*d*, making it possible to arbitrarily change the mounting positions of the temperature correction amount adjustment screws.

Next, the effects of the bimetal rim 46 and of the temperature correction amount adjustment screws 41 will be described. In the case where a material the Young's modulus of which linearly varies with respect to temperature change, such as iron, is used for the hairspring of the balance with hairspring, the Young's modulus of the hairspring is lowered when the temperature of the hairspring rises as a result, for example, of a rise in temperature, so that the vibration cycle increases, and the timepiece loses. To compensate for this loss, the bimetal rim changes the moment of inertia of the balance with hairspring with temperature change. In the case, for example, where the temperature rises, when the moment of inertia of the balance with hairspring is reduced, the vibration cycle decreases, and the timepiece gains. That is, the bimetal rim 46 and the temperature correction amount adjustment screws 41 compensate for a change in the vibration cycle generated in the hairspring through a change in the moment of inertia of the balance with hairspring.

The coefficient of thermal expansion of the outer rim 43 of the bimetal rim 46 is larger than that of the inner rim 42 thereof; thus, when, for example, the temperature rises, the curvature of the bimetal rim 46 increases due to this difference. The stationary end 40 of the bimetal rim 46 is fixed to the second arm 20, so that, when the curvature of the bimetal rim 46 increases, the nearer to the free end 45, the nearer to the balance staff 4. When the mass of the bimetal rim 46 and of the temperature correct ion amount adjustment screws 41 mounted to the bimetal rim 46 approximates that of the balance staff 4, the moment of inertia is reduced, and the vibration cycle is shortened. To adjust the degree of change in vibration cycle, the positions of the temperature correction amount adjustment screws 41 are changed. That is, when a large number of temperature correction amount adjustment screws are mounted at positions near the free end 45, the degree of change in vibration cycle is larger; and when a large number of temperature correction amount adjustment screws are mounted at positions near the stationary end 40, the degree of change in vibration cycle is smaller. To prevent unbalance in center of gravity, the temperature correction amount adjustment screws 41 are always mounted in pairs at position where they are opposite each other with the balance staff 4 therebetween. Thus, when changing the mounting positions of the temperature correction amount adjustment screws 41, it is necessary to simultaneously move the paired temperature correction amount adjustment screws 41. The mounting positions of the temperature correction amount adjustment screws are adjusted such that the change amount in vibration cycle due to a change in the Young's modulus of the hairspring 2 is close to change amount in vibration cycle due to a change in the moment of inertia of the bimetal rim 46, whereby it is possible to provide a balance with hairspring of higher precision which is little subject to a change in vibration cycle if the temperature around the balance with hairspring changes.

Thus, according to the present embodiment, it is possible to provide a balance with hairspring of higher precision which exhibits, in addition to the effects of the above embodiments, is little subject to a change in vibration cycle if the temperature changes. Further, instead of being a modification of the second embodiment, the present embodiment may be a modification of the first embodiment and of the third embodiment.

Further, instead of being provided radially on the outer side of the second rim, the bimetal rim of the present embodiment may be provided on the inner side.

Further, the material combination of the bimetal rim of the present embodiment may be a combination of materials other than those mentioned in the present embodiment so long as they are materials differing in coefficient of thermal expansion.

Figure 10A:
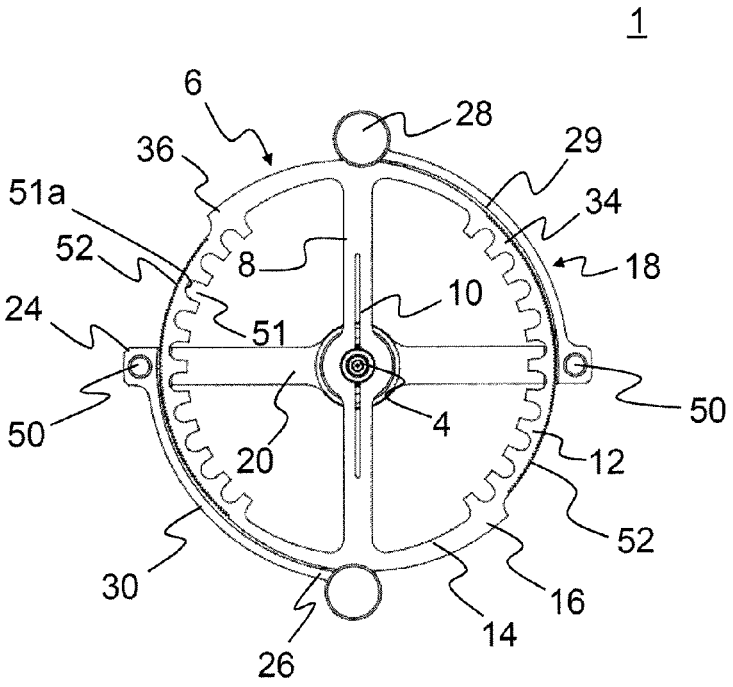
FIG. 10A is a plan view of the balance with hairspring according to a fifth embodiment of the present invention when the moment of inertia thereof is set to medium.
Figure 10B:
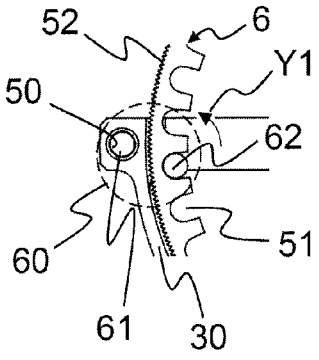
FIGS. 10B, 10C, and 10D are plan views illustrating how the phase of a first rim is adjusted with respect to a second rim.
Figure 10C:
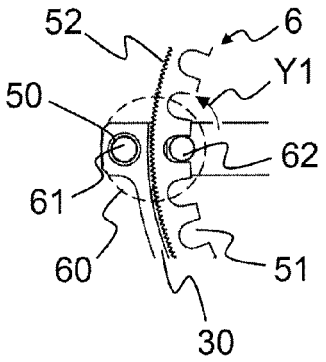
Figure 10D:
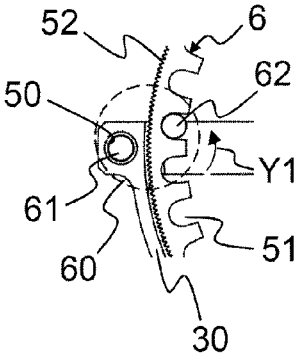

Next, the fifth embodiment of the present invention will be described with reference to FIG. 10. FIG. 10A is a plan view of the balance with hairspring when the moment of inertia thereof is set to medium, and FIGS. 10B, 10C, and 10D are plan views illustrating how the phase of the first rim 6 is adjusted with respect to the second rim 18. The components that are the same as those of the first embodiment are indicated by the same reference numerals, and a description thereof will be left out.

The present embodiment differs from the first embodiment in that a phase adjustment groove 51 is provided in the inner periphery of the first rim 6, that a scale 52 is provided in the outer periphery of the first rim 6, and that a phase adjustment hole 50 is provided at the stationary end 24 of the second rim 18.

In the present embodiment, of a support portion 12 and a guide portion 14 in the inner periphery of the first rim 6, the support portion 12 is provided with the phase adjustment groove 51 at every 10 degrees. Further, on the outer peripheral side of the portion of the first rim where the position adjustment grooves 51 are provided, there is provided the scale 52, which is graduated at every one degree. Further, the phase adjustment hole 50 is provided at the stationary end 24 of the second rim.

Next, the phase adjustment method will be described. A jig 60 is provided with a first protrusion 61 and a second protrusion 62. The diameter of the first protrusion 61 is smaller than that of the phase adjustment hole 50, and the diameter of the second protrusion 62 is smaller than the diameter of an arcuate bottom portion 51*a* of each phase adjustment groove 51. In FIG. 10A, when the first rim 6 is to be rotated clockwise, the first protrusion 61 of the jig 60 is engaged with the phase adjustment hole 50, and the second protrusion 62 is engaged with one of the phase adjustment grooves 51 before rotating the jig 60 counterclockwise in the direction Y1, as shown in FIG. 10B. Then, the jig 60 rotates around the first protrusion 61, and the second protrusion pushes the side surface of the phase adjustment groove 51, whereby the first rim 6 is rotated clockwise, and the state of FIG. 10D is attained via the state of FIG. 10C. In the state of FIG. 10D, the jig 60 cannot be further rotated counterclockwise, so that the jig 60 is once removed from the balance with hairspring 1, and the jig 60 is engaged again so as to attain the engagement state of FIG. 10B to repeat the same operation. The scale 52 is provided in the outer periphery of the first rim 6, so that, by, for example, counting the number of scale graduations having passed the stationary end 24, it is possible to easily grasp the phase change amount of the first rim. Further, when the change amount in vibration cycle per rotational angle of the first rim 6 is previously computed, it is possible to know, for example, the number of scale graduations by which the first rim 6 is to be rotated counterclockwise when the rate of the timepiece is to gain by ten seconds.

Further, while in the present embodiment the phase adjustment grooves are provided in the first rim, and the phase adjustment hole is provided in the second rim, it is also possible to provide the phase adjustment grooves in the second rim and the phase adjustment hole in the first rim.

In the present embodiment, there is provided a phase adjustment mechanism for adjusting the phase of the first rim and of the second rim. In the present embodiment described above, it is possible to perform phase adjustment on the first rim 6 and the second rim 18 easily and correctly, so that it is possible to provide a balance with hairspring of higher precision.

The present invention is not restricted to the above embodiments but allows various modifications.

It is also possible to combine different embodiments with each other; for example, it is possible to apply the guide portion of the third embodiment to the second embodiment.

Further, instead of being of the cantilever-type structure having the stationary end and the free end, the elastic portion may be of a double-end supported beam type structure having stationary ends at both ends of the arc. In this case also, it is possible to provide the same effect as that of the above embodiments if the curvature of the elastic portion is different from that of the first rim.

What is claimed is:

1. A balance with hairspring comprising:

a balance staff;

a balance wheel arranged around the balance staff;

a first rim constituting the balance wheel and having a guide portion configured to vary in the distance from the balance staff in correspondence with a peripheral direction around the balance staff; and a second rim having an elastic portion arranged so as to be slidable along the guide portion and capable of elastic deformation in the radial direction around the balance staff, and a plurality of weight portions arranged in the peripheral direction.

2. The balance with hairspring according to claim 1, wherein the second rim has a contact portion configured to come into contact with the first rim through the elastic deformation of the elastic portion; and the contact portion is formed in the vicinity of the weight portions.

3. The balance with hairspring according to claim 2, wherein the guide portion has an inclined surface inclined such that the distance from the balance staff uniformly varies along the peripheral direction around the balance staff.

4. The balance with hairspring according to claim 3, wherein the second rim has an engagement portion configured to be engaged with the first rim through elastic deformation of the elastic portion; and the engagement portion is engaged with the first rim, whereby the sliding movement of the second rim along the guide portion is fixed.

5. The balance with hairspring according to claim 3, wherein the first rim is equipped with a slit having a width smaller than the diameter of the balance staff.

6. The balance with hairspring according to claim 2, wherein the second rim has an engagement portion configured to be engaged with the first rim through elastic deformation of the elastic portion; and the engagement portion is engaged with the first rim, whereby the sliding movement of the second rim along the guide portion is fixed.

7. The balance with hairspring according to claim 2, wherein the first rim is equipped with a slit having a width smaller than the diameter of the balance staff.

8. The balance with hairspring according to claim 1, wherein the guide portion has an inclined surface inclined such that the distance from the balance staff uniformly varies along the peripheral direction around the balance staff.

9. The balance with hairspring according to claim 8, wherein the second rim has an engagement portion configured to be engaged with the first rim through elastic deformation of the elastic portion; and the engagement portion is engaged with the first rim, whereby the sliding movement of the second rim along the guide portion is fixed.

10. The balance with hairspring according to claim 8, wherein the first rim is equipped with a slit having a width smaller than the diameter of the balance staff.

11. The balance with hairspring according to claim 1, wherein the second rim has an engagement portion configured to be engaged with the first rim through elastic deformation of the elastic portion; and the engagement portion is engaged with the first rim, whereby the sliding movement of the second rim along the guide portion is fixed.

12. The balance with hairspring according to claim 1, wherein the first rim is equipped with a slit having a width smaller than the diameter of the balance staff.

13. The balance with hairspring according to claim 1, wherein the first rim has a support portion at a fixed distance from the balance staff in correspondence with the peripheral direction around the balance staff;

the guide portion is formed between a first end portion at a first distance from the balance staff and a second end portion at a second distance from the balance staff which is smaller than the first distance; and the elastic portion is formed in an arc length smaller than the arc length between the first end portion and the second end portion on the support portion.

14. The balance with hairspring according to claim 1, wherein the guide portion is formed on the outer peripheral surface of the first rim.

15. The balance with hairspring according to claim 1, wherein the guide portion is formed on the inner peripheral surface of the first rim.

16. The balance with hairspring according to claim 1, wherein the guide portion has an auxiliary guide portion retaining the elastic portion from the outer peripheral side.

17. The balance with hairspring according to claim 1, wherein there is provided a rim formed of a bimetal.

18. The balance with hairspring according to claim 1, wherein there is provided a phase adjustment mechanism for adjusting the phase of the first rim and of the second rim.

19. A movement which is equipped with an escapement/governor mechanism including a balance with hairspring as claimed in claim 1, and a train wheel.

20. A timepiece which contains a movement as claimed in claim 1, and which is equipped with an exterior member having a dial.

* * * * *